US010252532B2

(12) United States Patent
Mitsuo et al.

(10) Patent No.: US 10,252,532 B2
(45) Date of Patent: Apr. 9, 2019

(54) PRINTING APPARATUS AND LIQUID DISCHARGING CONTROL METHOD

(71) Applicant: SEIKO EPSON CORPORATION, Tokyo (JP)

(72) Inventors: Noritaka Mitsuo, Nagano (JP); Kenji Otokita, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/560,859

(22) PCT Filed: Mar. 18, 2016

(86) PCT No.: PCT/JP2016/001605
§ 371 (c)(1),
(2) Date: Sep. 22, 2017

(87) PCT Pub. No.: WO2016/157806
PCT Pub. Date: Oct. 6, 2016

(65) Prior Publication Data

US 2018/0117916 A1 May 3, 2018

(30) Foreign Application Priority Data

Mar. 30, 2015 (JP) ..... 2015-068019

(51) Int. Cl.
*B41J 29/38* (2006.01)
*B41J 2/165* (2006.01)
(Continued)

(52) U.S. Cl.
CPC ..... *B41J 2/16523* (2013.01); *B41J 2/155* (2013.01); *B41J 2/16526* (2013.01);
(Continued)

(58) Field of Classification Search
USPC ..... 347/9, 22, 34
See application file for complete search history.

(56) References Cited

U.S. PATENT DOCUMENTS 8,205,972 B2 * 6/2012 Hara ..... B41J 2/16517 347/22
2008/0111851 A1 5/2008 Muhl
(Continued)

FOREIGN PATENT DOCUMENTS

JP 2004-009474 A 1/2004
JP 2005-111880 A 4/2005
(Continued)

OTHER PUBLICATIONS

The Extended European Search Report for the corresponding European Patent Application No. 167716992 dated Oct. 31, 2018.

*Primary Examiner* — Lam S Nguyen

(57) ABSTRACT

The printing apparatus includes a printing head that includes a plurality of nozzles including a first nozzle, a discharging controller that is capable of controlling discharging of liquid from the plurality of nozzles, a transportation section that relatively moves a recording medium and the printing head by transporting at least either or both of the recording medium and the printing head, and a suction section that includes a suction port which is positioned at an upstream side or a downstream side of the printing head in a relative moving direction of the printing head and the recording medium. The discharging controller controls the first nozzle to discharge mist type ink droplets at a timing of not discharging ink droplets for forming image from the first nozzle, and the suction section suctions the mist type ink droplets discharged from the first nozzle through the suction port.

6 Claims, 7 Drawing Sheets

(51) Int. Cl.

| | |
|---|---|
| ***B41J 2/17*** | (2006.01) |
| ***B41J 2/155*** | (2006.01) |
| *B41J 25/00* | (2006.01) |

(52) U.S. Cl.
CPC ..... *B41J 2/1714* (2013.01); *B41J 2002/1657* (2013.01); *B41J 2002/16573* (2013.01); *B41J 2025/008* (2013.01)

(56) References Cited

U.S. PATENT DOCUMENTS

| | | | | |
|---|---|---|---|---|
| 2011/0234663 | A1* | 9/2011 | Ohhashi | B41J 2/16588 347/9 |
| 2012/0007916 | A1* | 1/2012 | Kumagai | B41J 2/1714 347/34 |
| 2012/0033016 | A1 | 2/2012 | Stadler | |
| 2012/0113187 | A1 | 5/2012 | Kiuchi et al. | |
| 2013/0229460 | A1 | 9/2013 | Masuda | |
| 2014/0104343 | A1 | 4/2014 | Masuda | |
| 2014/0354731 | A1 | 12/2014 | Masuda | |

FOREIGN PATENT DOCUMENTS

| | | | |
|---|---|---|---|
| JP | 2005-186422 | A | 7/2005 |
| JP | 2009-006488 | A | 1/2009 |
| JP | 2012-091365 | A | 5/2012 |
| JP | 2012-192669 | A | 10/2012 |
| JP | 2013-169681 | A | 9/2013 |
| JP | 2013-173313 | A | 9/2013 |
| JP | 2013-180539 | A | 9/2013 |
| JP | 2013-226699 | A | 11/2013 |

* cited by examiner

PRINTING APPARATUS AND LIQUID DISCHARGING CONTROL METHOD

This application is a U.S. national phase application of PCT/JP2016/001605, which claims priority to Japanese Patent Application No. 2015-068019, filed on Mar. 30, 2015. The entire disclosure of Japanese Patent Application No. 2015-068019 is hereby incorporated herein by reference.

TECHNICAL FIELD

The present invention relates to a printing apparatus.

BACKGROUND ART

In an ink jet type printer, an image is formed by discharging ink from nozzles of an ink jet head onto a print sheet. In the nozzle of the ink jet head, there is a concern that the ink is not appropriately discharged because of thickening of ink due to drying of ink inside the nozzle, intrusion of bubbles into the nozzle, attaching of foreign matter such as paper powder near the nozzle, and the like. Here, various technologies are proposed in which the ink is discharged from each of the nozzles regardless of discharging the ink for forming the image (hereinafter, refer to as "flushing"), and thickened ink, the intruding bubbles, and the paper powder in the nozzles or near the nozzles is removed. PTL 1 discloses a technology in which the flushing is performed by discharging the ink from all of the nozzles in a line head printer which performs printing on a belt type print sheet (continuous form) in a period from finishing of printing on a print region of any page to start of printing on a print region of the next page.

CITATION LIST

Patent Literature

PTL 1: JP-A-2004-9474

SUMMARY OF INVENTION

Technical Problem

According to a line head printer disclosed in PTL 1, a test pattern is printed between the print regions of two pages by flushing. For this reason, in a case in which printing of the test pattern is not allowed, there is a problem in that the flushing cannot be performed. In addition, when the flushing is performed in a case in which a width of a print medium is narrower than a width of a line head, the ink is likely to attach to a member positioned under the print medium, for example, a platen, or the like, and thus there is a problem in that the flushing cannot be performed. In addition, when the flushing is performed after stopping the printing and moving the line head away to a position not facing the print medium, there is a problem in that print throughput is decreased. In addition, in a case where the flushing is performed by discharging the minimum amount of the ink from a nozzle in which the ink for forming the image is not discharged when printing is performed on the print region, there is a problem in that image quality is deteriorated due to the ink droplets in the flushing which are landed onto the print region.

Moreover, each of the problems described above is not limited to the line head printer, and also occurs in a printer, a so called serial head printer, which performs printing by performing scanning using the printing head in a width direction of the sheet. For example, since a scanning distance of the printing head becomes significantly great in the serial head printer which performs printing on a sheet having a significantly great width, the flushing needs to be performed during the scanning in some cases, and the same problem as the problem in the line head printer described above occurs in the serial head printer in a case in which the flushing is performed during the scanning. In addition, the same problem also occurs in the printing apparatus capable of discharging arbitrary liquid, which is not limited to the ink. Therefore, for the printing apparatus, a technology capable of suppressing deterioration of the image quality or the print throughput by the flushing is required.

Solution to Problem

The invention is made to solve a part or all problems described above, and can be realized in the following aspects.

(1) According to an aspect of the present invention, there is provided a printing apparatus which forms an image by discharging liquid onto a recording medium based on image data. The printing apparatus includes a printing head that includes a plurality of nozzles including a first nozzle and discharges the liquid from the plurality of nozzles, a discharging controller that is capable of controlling discharging of the liquid from the plurality of nozzles, a transportation section that relatively moves the recording medium and the printing head; and a suction section that includes a suction port which is positioned at an upstream side or a downstream side of the printing head in a relative moving direction of the printing head and the recording medium, in which at a timing of not discharging ink droplets for forming the image as the liquid from the first nozzle, the discharging controller controls the first nozzle to discharge mist type ink droplets as the liquid, and the suction section suctions the mist type ink droplets discharged from the first nozzle through the suction port. According to the printing apparatus of the aspect, when the first nozzle does not discharge the ink droplets for forming the image, the mist type ink droplets are discharged from the first nozzle, and the suction section recovers liquid droplets. For this reason, the printing apparatus can suppress the mist type ink droplets to being attached to the recording medium or the printing head, and the printing head does not need to be away at the time of discharging the mist type ink droplets, and thus deterioration of the image quality and a decrease in the print throughput by the flushing can be suppressed.

(2) In the printing apparatus of the aspect, the plurality of nozzles may include a second nozzle different from the first nozzle, the discharging controller may control the second nozzle to discharge the mist type ink droplets, at a timing of discharging the ink droplets for forming the image from the first nozzle, and at a timing of not discharging the ink droplets for forming the image from the second nozzle, and the suction section and may perform the suctioning with a suction force which is not capable of recovering the ink droplets for forming the image discharged from the first nozzle and is capable of recovering the mist type ink droplets discharged from the second nozzle. According to the printing apparatus of the aspect, at a timing of discharging the ink droplets for forming the image from the first nozzle, the mist type ink droplets can be discharged from the second nozzle. For this reason, compared to a configuration in which the second nozzle discharges the mist type ink droplets only at a timing of not discharging the ink droplets for forming the image from the first nozzle, the print throughput is not decreased. In addition, at this time, the suction section performs the suctioning with the suction force which is not capable of recovering the ink droplets for forming the image discharged from the first nozzle, and is capable of recovering the mist type ink droplets discharged from the second nozzle, and thus it is possible to control the landing deviation of the ink droplets for forming the image discharged from the first nozzle. In addition, the second nozzle discharges the mist type ink droplets at a timing of discharging the ink droplets for forming the image from the first nozzle. Therefore, even when the recording medium is, for example, a band type print sheet (continuous form) and continuous printing is performed with respect to the recording medium, the second nozzle can discharge the mist type ink droplets (that is, flushing).

(3) In the printing apparatus of the aspect, the discharging controller may control the first nozzle to discharge the mist type ink droplets when the printing head is positioned at a position not facing a print region of the recording medium, and an amount of the mist type ink droplets discharged from the first nozzle when the printing head is positioned at a position not facing the print region of the recording medium may be greater than an amount of the mist type ink droplets discharged from the first nozzle when the printing head is positioned at a position facing the print region of the recording medium. According to the printing apparatus of the aspect, a significant amount of the mist type ink droplets can be discharged when the printing head is positioned at a position not facing the print region of the recording medium, compared to when the printing head is positioned at a position facing the print region of the recording medium, and thus clogging generated in the second nozzle is further reliably removed.

(4) In the printing apparatus of the aspect, the suction section may perform the suctioning with a stronger suction force in a case in which the first nozzle discharges the mist type ink droplets when the printing head is positioned at a position not facing the print region of the recording medium, than in a case in which the first nozzle discharges the mist type ink droplets when the printing head is positioned at a position facing the print region of the recording medium. According to the printing apparatus of the aspect, even when the great amount of the mist type ink droplets are discharged from the second nozzle, the ink droplets are suctioned with the stronger suction force. Accordingly, attaching of the mist type ink droplets to the recording medium can be suppressed.

(5) In the printing apparatus of the aspect, when a predetermined time has elapsed after the first nozzle terminates to discharge the ink droplets for forming the image or the mist type ink droplets, the discharging controller may control the first nozzle to discharge the mist type ink droplets. According to the printing apparatus of the aspect, when a predetermined period has elapsed after terminating discharging the ink droplets for forming the image or the mist type ink droplets from the first nozzle, the first nozzle discharges the mist type ink droplets. Accordingly, in the first nozzle, thickened liquid, bubbles, attached foreign matter, or the like can be reliably suppressed.

(6) In the printing apparatus of the aspect, the plurality of nozzles may include a third nozzle different from the first nozzle, the transportation section moves only the recording medium out of the recording medium and the printing head, the printing head is a line head in which a first nozzle row including the first nozzle is arranged in a direction intersecting a moving direction of the recording medium, and a second nozzle row including the third nozzle is arranged parallel to the first nozzle row, and the suction section is disposed at a downstream side in the moving direction of the recording medium with respect to the printing head. According to the printing apparatus of the aspect, even when the printer head can not be moved and the flushing with the printing head being away cannot be performed, a deterioration of the image quality or decrease of the print throughput can be suppressed at least when the first nozzle discharges the mist type ink droplets and the flushing is performed.

a plurality of configuration components included in each of aspects of the invention described above are not necessary, and changing, removing, substituting by new configuration components, and removing a part of the plurality of limitation contents can be performed with respect to a part of the plurality of configuration components, in order to solve a part or all of the problems described above, or to achieve a part or all effects disclosed in the specification. In addition, in order to solve a part or all of the problems described above, or to achieve a part or all effects disclosed in the specification, an independent aspect of the invention can be provided by combining a part or all of technical features included in an aspect of the invention described above with a part or all of technical features included in the other aspect of the invention described above.

The invention can be realized in various forms. For example, it can be realized as a liquid ejecting apparatus, a liquid discharging control method, a flushing method of the printing apparatus, a computer program for realizing any one of the respective apparatuses and methods, a non-temporary recording medium on which the computer program is stored, or the like.

DESCRIPTION OF EMBODIMENTS (A. First Embodiment)

(A-1. Configuration of Apparatus)

Figure 1:
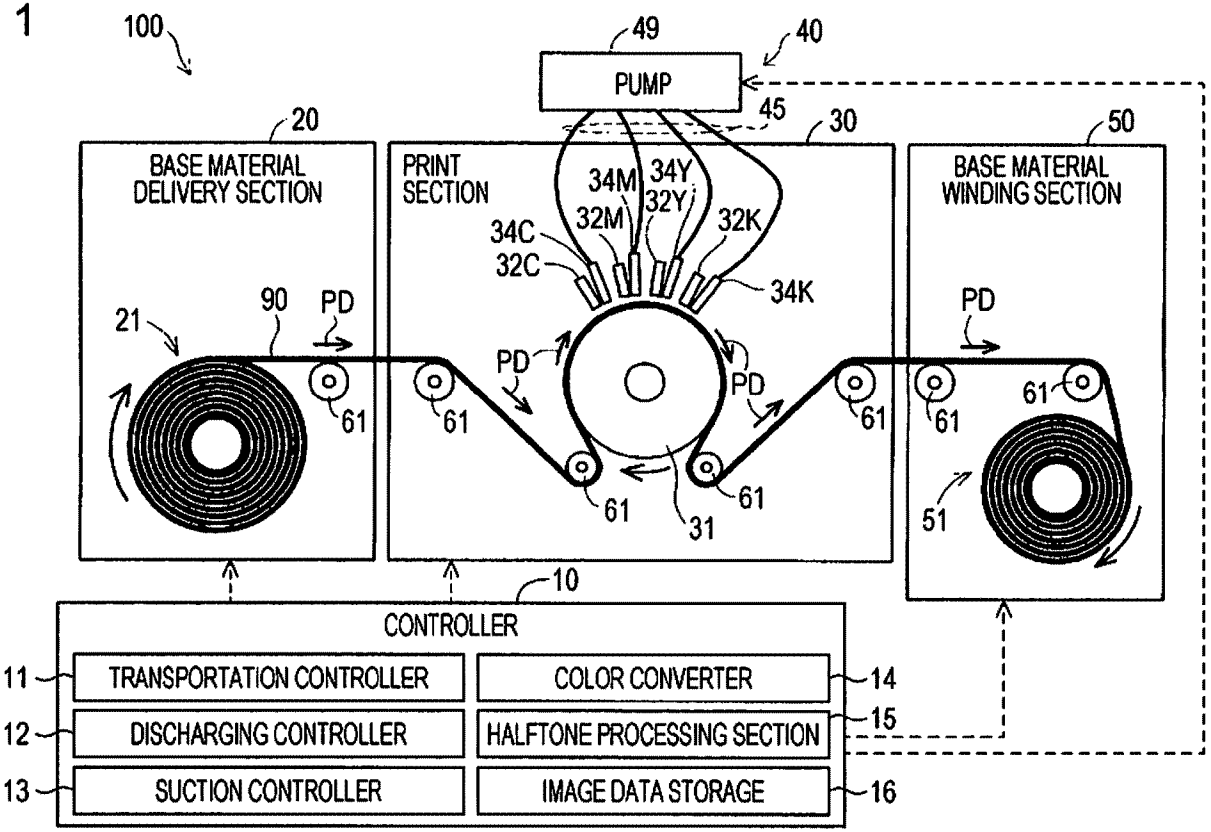
FIG. 1 is an explanation diagram illustrating a schematic configuration of a printing apparatus as an embodiment of the invention.

FIG. 1 is an explanation diagram illustrating a schematic configuration of a printing apparatus as an embodiment of the invention. A printing apparatus 100 is an ink jet type line head printer which forms an image by discharging ink droplets. The printing apparatus 100 transports a print base material 90 which is a band type recording medium in a longitudinal direction and performs a continuous printing. As the print base material 90, for example, gloss paper, coated paper, label paper, OHP film, or the like is used. In addition, as the print base material 90, regular paper, Japan paper, ink jet printing paper, fabric, or the like may be used.

The printing apparatus 100 includes a controller 10, a plurality of transportation rollers 61, a base material delivery section 20, a print section 30, a suction section 40, and a base material winding section 50.

The controller 10 is constituted by a microcomputer including a central processing unit (CPU), a random access memory (RAM), and a read only memory (ROM) which are not illustrated, and is capable of controlling each of configuration sections of the printing apparatus 100. The controller 10 includes a transportation controller 11, a discharging controller 12, a suction controller 13, a color converter 14, a halftone processing section 15, and an image data storage 16. Among these, the transportation controller 11, the discharging controller 12, the suction controller 13, the color converter 14, and the halftone processing section 15 are functional sections which are realized by moving a program stored in the ROM to the RAM and being performed through the CPU.

The transportation controller 11 controls transportation of the print base material 90 by controlling a motor (not illustrated) which respectively drives each of the transportation rollers 61 and a rotation drum 31 to be described later. The discharging controller 12 controls discharging of ink droplets in the print section 30. The described above "controlling discharging the ink droplets" means not only controls whether or not the ink droplets are discharged, but also controls an amount and a velocity of the ink being discharged. The discharging controller 12 selectively performs discharging the ink for forming the image and discharging ink for controlling clogging inside the nozzle Nz (hereinafter, refer to as "flushing") by performing an ink discharging control process to be described later. Clogging inside the nozzle Nz is caused by thickened ink in which viscosity of the ink is increased by drying the ink inside the nozzle Nz, bubbles inside the nozzle Nz, or foreign matter such as paper powder attached to a port of the nozzle Nz or around thereof.

The suction controller 13 controls the suction section 40. The color converter 14 converts image data expressed by a RGB (Red, Green, and Blue) color system into image data of a CMYK (Cyan, Magenta, Yellow, and Black) color system which are respective color of the ink with reference to a color conversion table (not illustrated). The halftone processing section 15 performs a so called halftone process which converts the image data expressed by the CMYK color system, for example, the image data in which one pixel is expressed by a 256-gradation, into bitmap data constituted by a combination of three types of large, middle, and small-sized dots having each color. The image data storage 16 is prepared in advance inside the RAM (not illustrated) which is included in the controller 10.

Each of the transportation rollers 61 is driven by the motor (not illustrated), and transports sheets in a transportation direction PD which is set by a position relationship between the adjacent transportation rollers 61. The transportation direction PD coincides with a transportation direction of the print base material 90 when the printing image is formed on the print base material 90 in the printing apparatus 100 (when the ink for forming the image is discharged). In the embodiment, "upstream" and "downstream" mean an upstream and a downstream of the transportation direction PD as a reference, and the base material delivery section 20 side becomes an upstream side, and the base material winding section 50 side becomes a downstream side.

The base material delivery section 20 includes a base material roller 21 in which the print base material 90 is wound in a roll type. The base material roller 21 is rotated at a predetermined rotation velocity by the motor (not illustrated) which is controlled by the discharging controller 12, and delivers the print base material 90 to the print section 30 positioned at the downstream.

The print section 30 includes the rotation drum 31, four line heads 32C, 32M, 32Y, and 32K, and discharges the ink droplets from the four line heads 32C, 32M, 32Y, and 32K onto the print base material 90 which is transported on the rotation drum 31 so as to form the image. Hereinafter, the four line heads 32C, 32M, 32Y, and 32K are collectively referred to as a "line head 32".

The rotation drum 31 is rotated at the predetermined rotation velocity by the motor (not illustrated) which is controlled by the transportation controller 11, and supports the print base material 90 and transports the print base material 90 in the circumferential side surface.

The four line heads 32C, 32M, 32Y, and 32K are arranged in parallel at predetermined intervals in the transportation direction PD along a circumferential side surface of the rotation drum 31. Specifically, the line head 32C is disposed on the most upstream side in the transportation direction PD, and the line head 32M is disposed a predetermined interval away in the transportation direction PD. The line head 32Y is disposed a predetermined interval away in the transportation direction PD, and the line head 32K is disposed a predetermined interval away in the transportation direction PD. The four line heads 32C, 32M, 32Y, and 32K discharge each of the ink having mutually different colors from each other. Specifically, the line head 32C discharges cyan (C) ink. In addition, the line head 32M discharges magenta (M) ink, the line head 32Y discharges yellow (Y) ink, and the line head 32K discharges black (K) ink. In each of the line heads, a plurality of the nozzles are arranged which are capable of discharging the ink droplets in a width direction of the print base material 90. Moreover, a detailed description of disposing the nozzles in each of the line heads will be described later. Each of the line heads is connected to a tank (not illustrated) which stores corresponding color ink through an ink supplying path, and the ink is supplied from such a tank. Each of the line heads discharges an amount of the ink (amount of ink droplet) in accordance with the instruction at a timing in accordance with instruction of the discharging controller 12, onto a printing surface of the print base material 90 which is transported by the rotation drum 31, therefore, the print image is formed.

The suction section 40 suctions and recovers the ink droplets (mist type ink droplets to be described later), which are not landed onto the print base material 90 and are floated, among the ink droplets which are discharged from the four line heads 32C, 32M, 32Y, and 32K. The suction section 40 includes four ink collecting sections 34C, 34M, 34Y, and 34K, four tubes 45, and a pump 49.

Each of the ink collecting sections is disposed near the downstream side of the transportation direction PD, with respect to the mutually different line heads. Specifically, the ink collecting section 34C is disposed near the downstream side of the transportation direction PD with respect to the line head 32C. In the same way, the ink collecting section 34M is disposed near the downstream side of the transportation direction PD with respect to the line head 32M. The ink collecting section 34Y is disposed near the downstream side of the transportation direction PD with respect to the line head 32Y. The ink collecting section 34K is disposed near the downstream side of the transportation direction PD with respect to the line head 32K. In each of the ink collecting sections, a suction port facing the rotation drum 31 is formed, and each of the ink collecting sections guides the mist type ink droplets absorbed from the suction port into the tube 45.

Each of the tubes 45 communicates with the mutually different line heads and the pump 49. In the embodiment, the tube 45 has flexibility, and may be constituted by, for example, a tube which is formed from silicon rubber, or the like. The pump 49 performs the suction with a predetermined suction force, under the control of the suction controller 13. As described above, the pump 49 communicates with the suction port of each of the ink collecting sections through each of the tubes 45. Therefore, when the pump 49 is driven, air in intervals between the suction port of each of the ink collecting sections and the print base material 90 (rotation drum 31), air in spaces near the intervals, and the mist type ink floating in the air are suctioned from the suction port into the pump 49. A filter is provided in the pump 49 (not illustrated), the mist type ink recovered with the air is collected, and is discharged to a tank for recovering the ink that is connected by the tube (not illustrated).

The base material winding section 50 is positioned at the downstream of the print section 30. The base material winding section 50 includes a winding roller 51 which is driven at the predetermined rotation velocity in accordance with the instruction of the transportation controller 11. The winding roller 51 winds the print base material 90 delivered from the print section 30. According to a configuration described above, the printing apparatus 100 successively performs printing on the print base material 90.

Figure 2:
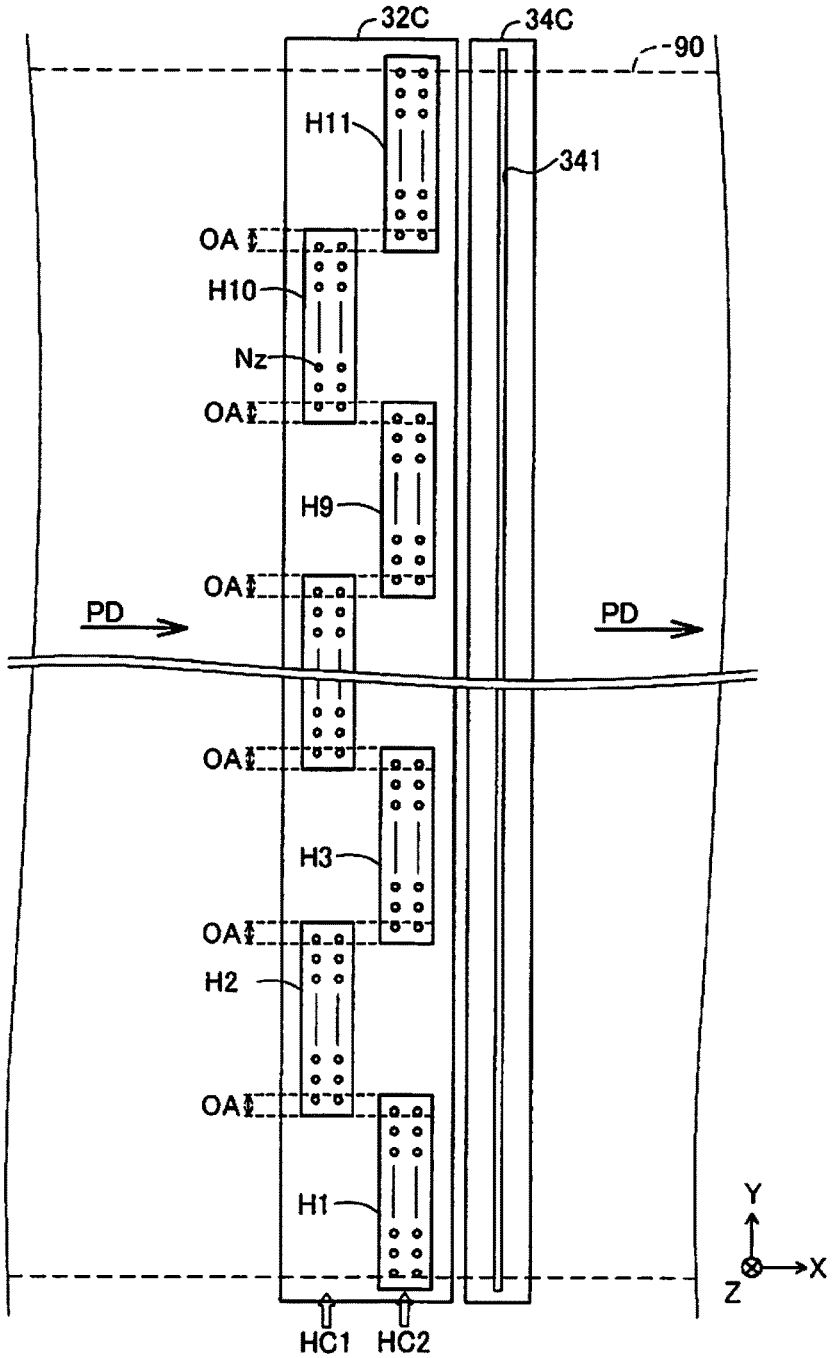
FIG. 2 is an explanation diagram illustrating a detailed configuration of a line head 32C and an ink collecting section 34C illustrated in FIG. 1.

FIG. 2 is an explanation diagram illustrating a detailed configuration of the line head 32C and the ink collecting section 34C illustrated in FIG. 1. FIG. 2 illustrates a plan view of the line head 32C and the ink collecting section 34C seen in a circumferential side surface direction of the rotation drum 31. Moreover, in FIG. 2, an X axis parallel to the transportation direction PD is set, Y axis parallel to a width direction of the print base material 90 is set, and Z axis parallel to a direction from the rotation drum 31 toward the line head 32C and the ink collecting section 34C is set. The X axis, Y axis, and Z axis intersect each other.

The line head 32C has a width greater than a width of the print base material 90 (length along Y axis). The line head 32C includes two short head rows HC1 and HC2. Each of the short head rows includes a plurality of the short heads which are arranged a predetermined interval away in parallel to a Y axis direction. In FIG. 2, two short heads H2 and H10 among five short heads included in the short head row HC1 are illustrated. In addition, in FIG. 2, four short heads H1, H3, H9, and H11 among six short heads included in the short head row HC2 are illustrated. Each of the short heads includes two nozzle rows which are configured to have many nozzles Nz arranged a predetermined interval away parallel to the Y axis. Moreover, FIG. 2 schematically illustrates a disposing position of each of the nozzles Nz. The short head row HC1 and the short head row HC2 include an overlap region OA overlapping in a Y axis direction. For example, an end portion of the short head H1 on the short head H3 side in the Y direction and an end portion of the short head H2 on the short head H1 side in the Y direction overlap with each other in the Y axis direction when seen in the X axis direction. The overlap region OA is provided in order to reduce image unevenness caused by a joint part of the short head. A dot formed on the overlap region OA is formed by the ink droplets discharged from the nozzle Nz of either of the short head of the short head row HC1 or the short head of the short head row HC2.

In the embodiment, the nozzle Nz communicates with a pressure chamber (not illustrated), and comes into contact with the pressure chamber and a piezoelectric resonance element. In the embodiment, the piezoelectric resonance element is a piezo element which is a capacitive load. The discharging controller 12 deforms a wall surface in contact with the pressure chamber by bending the piezo element, when supplying a predetermined driving signal to between the electrodes of the piezo element. When the pressure is applied to the pressure chamber in response to the deformation, the ink inside the pressure chamber is discharged from the nozzle Nz.

Figure 3:
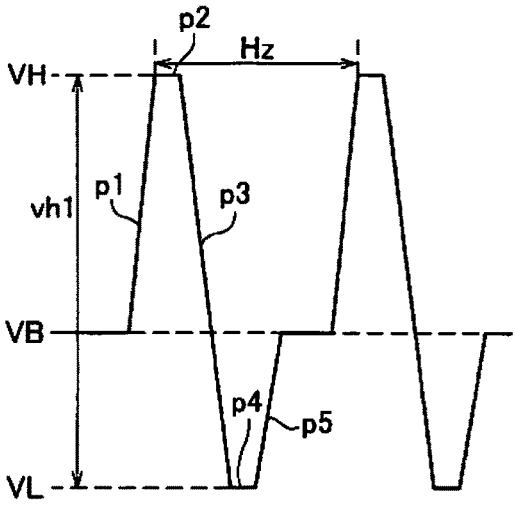
FIG. 3 is an explanation diagram illustrating one driving pulse which is included in a driving signal supplied to a piezoelectric resonance element by a discharging controller 12.

FIG. 3 is an explanation diagram illustrating one driving pulse included in the driving signal that is supplied to the piezoelectric resonance element by the discharging controller 12. In FIG. 3, a vertical axis indicates a potential of the driving pulse, and a horizontal axis indicates time. In addition, a potential difference (driving voltage) between a contraction potential VL which is the lowest potential of the driving pulse and an expansion potential VH which is the highest potential, is set to vh1. The driving pulse includes an expansion component p1 which expands the pressure chamber by changing the potential in a positive side from a reference potential VB to the expansion potential VH, an expansion maintaining component p2 which maintains the expansion potential VH at a constant time, a contraction component p3 which makes the pressure chamber rapidly contracted by changing the potential in a negative side from the expansion potential VH to the contraction potential VL, a contraction maintaining component p4 (damping hold) which maintains the contraction potential VL at a constant time, and a return component p5 which returns the potential from the contraction potential VL to the reference potential VB.

When the driving pulse is applied to the piezoelectric resonance element, it acts as follows. First, when the expansion component p1 is supplied to the piezoelectric resonance element, the piezoelectric resonance element is contracted, and the pressure chamber is changed from a reference capacity corresponding to the reference potential VB to the maximum capacity (here, expansion) corresponding to the expansion potential (highest potential) VH. Accordingly, a meniscus of the ink exposed in the nozzle Nz is suctioned in the pressure chamber side. An expansion state of the pressure chamber is constantly maintained for supplying period of the expansion maintaining component p2.

When the contraction component p3 next to the expansion maintaining component p2, which becomes a component changing a voltage in a direction opposite a direction where the voltage is changed by the expansion component p1, is supplied to a piezoelectric element, the piezoelectric resonance element is extended, and thus the pressure chamber is rapidly changed (here, it means contraction) from the maximum capacity to the minimum capacity corresponding to the contraction potential (minimum potential) VL. The ink inside the pressure chamber is pressurized because the pressure chamber is rapidly contracted, accordingly, a number of ink p1 to tens of ink p1 are discharged from the nozzle Nz. A contraction state of the pressure chamber is maintained briefly during a supply period of the contraction maintaining component p4, after that, the return component p5 is supplied to the piezoelectric resonance element, and is returned from a capacity at which the pressure chamber corresponds to the contraction potential VL to the reference capacity corresponds to the reference potential VB.

Here, when inclinations (absolute value of amount of voltage change per unit time) of the expansion component p1 and the contraction component p3 are further lowered, ejecting amount (amount of liquid droplets) from the nozzle can be reduced. Therefore, the discharging controller 12 is capable of distinctively discharging large, medium, and small-sized dots from the nozzle Nz by preparing the driving signal including a plurality of the driving pulses having different sizes of vh1 in a one print period and selecting any one or multiple driving signals out of them or by preparing a plurality of the driving signals having different sizes of vh1 and selecting any one of them. In addition, the discharging controller 12 is capable of discharging the ink droplets (hereinafter, referred to as "ink droplets for forming image") for forming the dots which form the image based on image data, and the ink droplets (hereinafter, referred to as "mist type ink droplets"), which are not landed onto the print base material 90 and are floated, and then can be suctioned and recovered by the suction section 40 from the nozzle Nz, by preparing the driving signal including a plurality of the driving pulses having different sizes of vh1 in a one print period and selecting any one or multiple having driving signals out of them or by preparing a plurality of the driving signals having different sizes of vh1 and selecting any one of them. As described later, the mist type ink droplets correspond to ink droplets which are not landed onto the print base material 90, after being discharged from the nozzle Nz onto the print base material 90, and are floated in the interval between the nozzle Nz and the print base material 90. Moreover, a type of the driving signal is not limited to a type illustrated in FIG. 3, and a signal of an arbitrary type capable of discharging the ink droplets may be used.

The ink collecting section 34C illustrated in FIG. 2 has a width equal to or more than the line head 32C. The ink collecting section 34C is disposed in parallel to the line head 32C at a position slightly away from the downstream side with respect to the line head 32C. The suction port 341 is formed on an end surface of the rotation drum 31 side in a Z direction of the ink collecting section 34C. In the embodiment, the suction port 341 is formed as one port of a slit shape extending in a width direction (including length in width direction). The suction port 341 is disposed so that the longitudinal direction thereof is parallel to the Y axis.

In addition, the line heads 32M, 32Y, and 32K and the ink collecting sections 34M, 34Y, and 34K also includes the same configuration, therefore, detailed descriptions thereof will not be repeated.

Each of the line heads corresponds to a subordinate concept of a printing head in Claims. In addition, the nozzle Nz included in each of the line heads corresponds to a subordinate concept of the plurality of nozzles including the first nozzle. In addition, an arbitrary nozzle Nz at least a part of the plurality of the nozzles Nz corresponds to a subordinate concept of a first nozzle in Claims. Two nozzles Nz belong to the mutually different short head rows, in an overlap region OA, between the two nozzles Nz overlapped with each other when seen in the transportation direction PD, one nozzle Nz corresponds to the subordinate concept of the first nozzle in Claims, and the other nozzle Nz corresponds to a subordinate concept of a second nozzle and a third nozzle in Claims. The print base material 90 corresponds to the subordinate concept of a recording medium in Claims. The transportation roller 61, the rotation drum 31, and the transportation controller 11 correspond to a subordinate concept of a transportation section in Claims. The transportation direction PD corresponds to a subordinate concept of a relative moving direction in Claims.

A-2. Print Process

Figure 4:
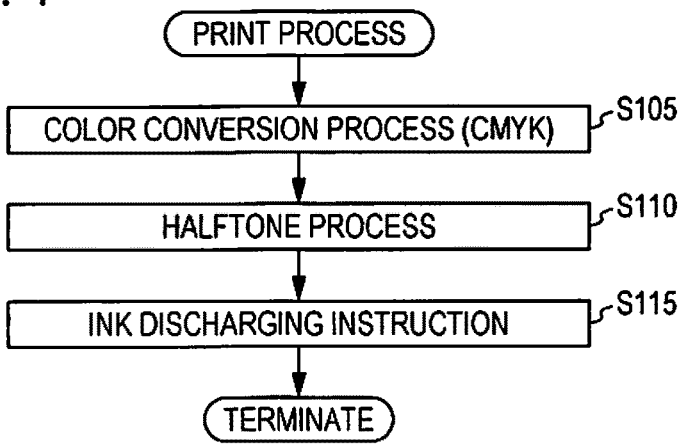
FIG. 4 is a flow chart illustrating a procedure of a printing process which is performed in a printing apparatus 100.

FIG. 4 is a flow chart illustrating a procedure of a print process being performed in the printing apparatus 100. The image data is stored in the image data storage 16 by a user. When the image is instructed to be printed on the basis of the image data, the print process in the printing apparatus 100 is performed. In this embodiment, the image data stored in the image data storage 16 is RGB-colored image data.

The color converter 14 converts the image data into image data of a CMYK color system (Step S105). The halftone processing section 15 performs a halftone process on the color-converted image data, in which the color-converted image data is converted into a bit map data that is expressed using the dots turned ON and OFF, the dots have sizes (large, middle, and small) of each of colors (Step S110). In the halftone process, for example, a systematic dither method in which a dither mask is used may be adopted. The halftone processing section 15 stores the bit map data obtained in the halftone process in a predetermined region inside the RAM of the printing apparatus 100 (Step S115), and instructs discharging the ink for forming the dot. Then, the print process is terminated. In the printing apparatus 100, based on the instruction of discharging of the ink obtained in Step S115, the ink is discharged onto the print base material 90 by the ink discharging control process to be described later, and thus the image is formed on the print base material 90.

A-3. Ink Discharging Control Process

Figure 5:
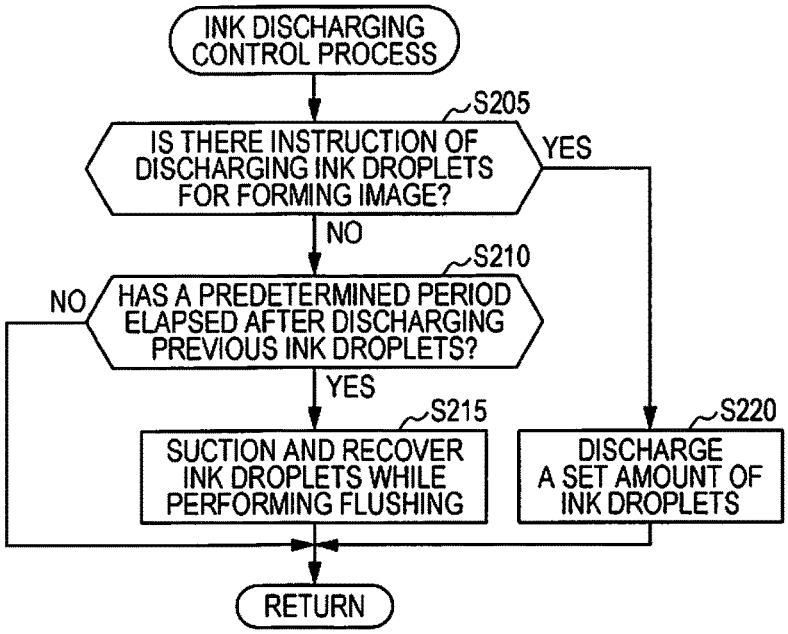
FIG. 5 is a flow chart illustrating a procedure of an ink discharging control process in a first embodiment.

FIG. 5 is a flow chart illustrating a procedure of the ink discharging control process in the first embodiment. In the printing apparatus 100, the ink discharging process is performed when turning on a power thereof.

The discharging controller 12 determines whether or not the bit map data is stored in a predetermined region in the RAM in the printing apparatus 100 so as to determine presence or absence of the instruction of discharging the ink droplets for forming the image (Step S205). As described above, when the print process is performed, the bit map data which describes the image to be printed is stored in the RAM. The bit map data is expressed by the dots for forming the image turned ON and OFF, and ON corresponds to an instruction of a predetermined amount of discharging of the ink droplets for forming the dot having a corresponding size.

When it is determined that there is an instruction of discharging of the ink droplets for forming the image (Step S205: YES), the discharging controller 12 outputs the driving signal to the piezoelectric resonance element corresponding to each of the nozzle Nz which is an instruction target for discharging of the ink droplets for forming the image based on the bit map data, and discharges the ink droplets for forming the image (Step S220). A print procedure returns to Step S205 described above.

In regard to the above description, with respect to the nozzle Nz when it is determined that there is no instruction of discharging of the ink droplets for forming the image (Step S205: NO), the discharging controller 12 determines whether or not a predetermined period has elapsed after discharging the previous ink droplets in each of the nozzles Nz (Step S210). The ink droplets are discharged when the image is printed, and when the flushing is performed in Step S215 to be described later. When it is determined that the predetermined period has not elapsed after discharging the previous ink droplets (Step S210: NO), the procedure returns to Step S205. Meanwhile, when it is determined that the predetermined period has elapsed after discharging the previous ink droplets (Step S210: YES), the discharging controller 12 performs the flushing, in addition, the suction controller 13 suctions the mist type ink droplets by controlling the suction section 40 (Step S215). The procedure returns to Step S205 described above. Here, the predetermined period in Step S210 may be different depending on whether discharging of the previous ink droplets is discharging of the ink droplets for forming the image, or is the flushing (discharging mist type ink droplets). In this case, the predetermined period becomes longer in a case in which discharging of the previous ink droplets is discharging of the ink droplets for forming the image.

In Step S215 described above, the discharging controller 12 discharges the mist type ink droplets from the nozzle Nz when performing the flushing. In addition, the discharging controller 12 suctions the ink droplets with suction force capable of suctioning the mist type ink droplets by controlling the pump 49. In the embodiment, "suction force capable of suctioning the mist type ink droplets" in Step S215 means suction force that is capable of suctioning the mist type ink droplets which are floated in the interval between the nozzle Nz and the print base material 90 as described above, and is not large enough to affect the density of the ink droplets landing to form the image. A setting method of such a "suction force" will be described with reference to FIG. 6A to FIG. 7C.

Figure 6A:
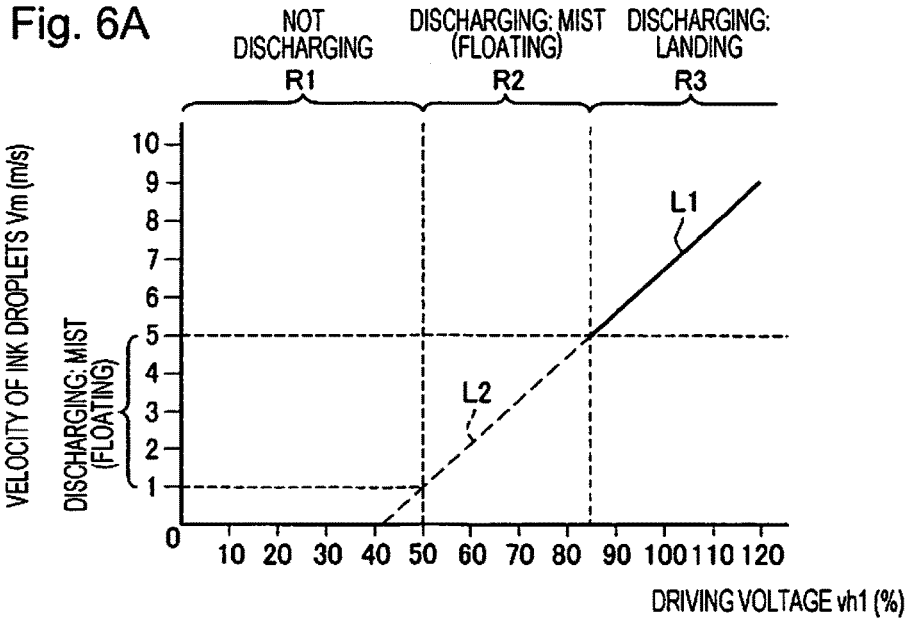
FIG. 6A is an explanation diagram illustrating an example of a relationship between a driving voltage and an ink droplet velocity, and a relationship between the driving voltage and an ink droplet amount.
Figure 6B:
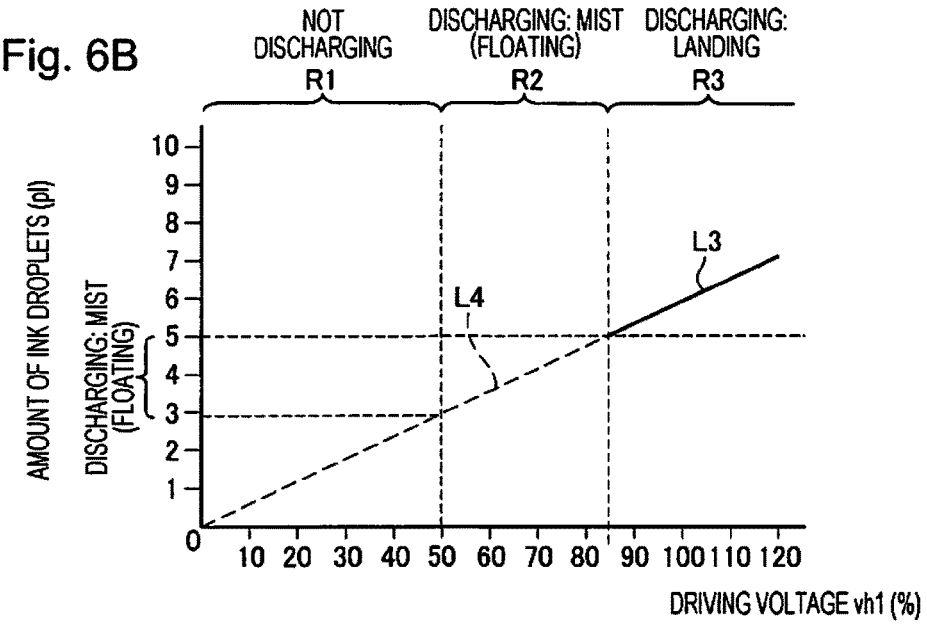
FIG. 6B is an explanation diagram illustrating an example of a relationship between a driving voltage and an ink droplet velocity, and a relationship between the driving voltage and an ink droplet amount.

FIGS. 6A and 6B are explanation diagrams illustrating an example of a relationship between the driving voltage and velocity of the ink droplets, and an example of a relationship between the driving voltage and the ink droplet amount. FIG. 6A illustrates the relationship between the driving voltage and the velocity of the ink droplets, and FIG. 6B illustrates a relationship between the driving voltage and the ink droplet amount. In FIG. 6A, a horizontal axis indicates the driving voltage in the driving signal which is output from the discharging controller 12, and a vertical axis indicates a flying velocity (m/s) of the ink droplets which are discharged from the nozzle Nz. In FIG. 6B, the horizontal axis is the same as the horizontal axis in FIG. 6A, and the vertical axis indicates an amount of the ink droplets discharged from the nozzle Nz (p1: picoliter). Moreover, in FIG. 6A and FIG. 6B, the driving voltage of the horizontal axis is a voltage corresponding to the driving voltage vh1 illustrated in FIG. 3, a case in which a voltage being applied at the time of general printing is set to 100% is illustrated. Results illustrated in FIG. 6A and FIG. 6B can be obtained by performing an experiment in which the piezoelectric resonance element is driven by changing the driving voltage, and an amount of the discharged ink droplets and the flying velocity are measured.

As illustrated in FIG. 6A by a straight line L1, the ink droplets are landed onto the print base material 90 within a voltage range R3 in which the driving voltage is equal to or more than 85%. In addition, in the voltage range R3, when the driving voltage increases, the flying velocity of the ink droplets also increases. This tendency is also assumed in a case in which the driving voltage is within voltage ranges R1 and R2 where the voltage range is less than 85% as illustrated in FIG. 6A by a straight line L2 of a broken line. The described above "being assumed" is expressed because the ink droplets are not discharged straightly when the driving voltage is within the voltage ranges R1 and R2, therefore, the flying velocity cannot be accurately measured.

Here, when the flying velocity of the ink droplets is approximately within a range of 1 m/s to 5 m/s, the discharged ink droplets are floated in the air without being landed onto the print base material 90. In other words, when the flying velocity of the ink droplets is approximately within a range of 1 m/s to 5 m/s, the discharged ink droplets become the mist type ink droplets. An amount of the discharged ink droplets by the driving voltage for obtaining the flying velocity is approximately 3 p1 to 5 p1, as illustrated in FIG. 6B. In order to discharge the mist type ink droplets, the discharging controller 12 supplies a signal of the driving voltage within the voltage range R2 of 50% to 85% at the time of general printing to the piezoelectric resonance element.

As illustrated in FIG. 6B by a straight line L3, the ink droplets are landed onto the print base material 90 within a voltage range R3 in which the driving voltage is equal to or more than 85%. In addition, in the voltage range R3, when the driving voltage increases, the ink droplet amount of the ink droplets also increases. This tendency is also assumed in a case in which the driving voltage is within voltage ranges R1, and R2 where the voltage range is less than 85% as illustrated in FIG. 6B by a straight line L4 of a broken line. The described above "being assumed" is expressed because the ink droplets are not landed straightly when the driving voltage is within the voltage ranges R1 and R2, therefore, the ink droplet amount cannot be accurately measured. Moreover, in the voltage range R1 of the driving voltage less than 50%, as illustrated in FIG. 6B, based on the straight line L4, the ink droplets less than 3 pl can be discharged, but the ink droplets are not substantially discharged (flying) from the port of the nozzle Nz.

Figure 7A:
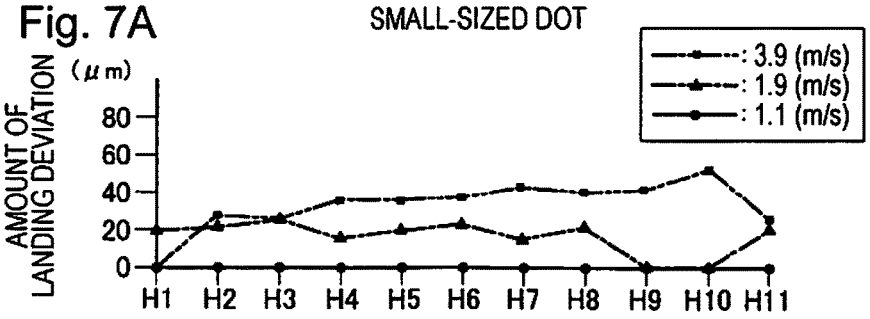
FIG. 7A is an explanation diagram illustrating a relationship between velocity of wind near a print base material 90 according to the suctioning and the landing deviation in the print base material 90.
Figure 7B:
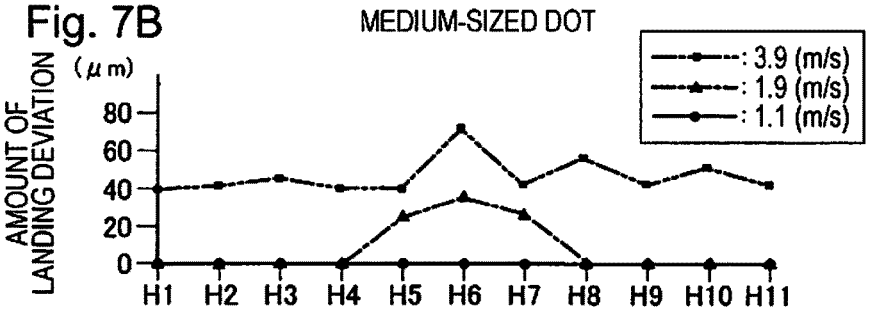
FIG. 7B is an explanation diagram illustrating the relationship between the velocity of wind near the print base material 90 according to the suctioning and the landing deviation in the print base material 90.
Figure 7C:
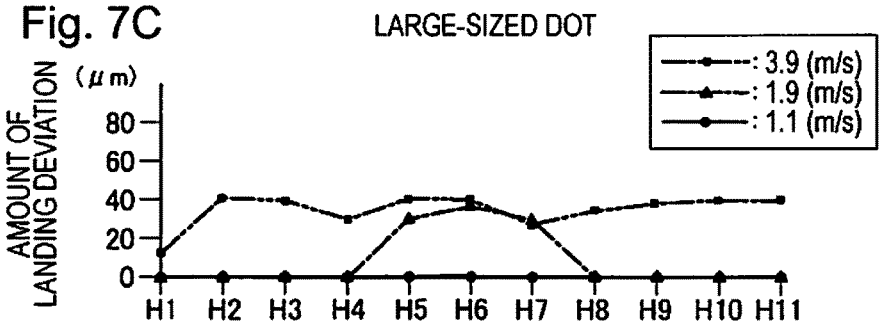
FIG. 7C is an explanation diagram illustrating the relationship between the velocity of wind near the print base material 90 according to the suctioning and the landing deviation in the print base material 90.

FIGS. 7A to 7C are explanation diagrams illustrating a relationship between a velocity of wind near the print base material 90 according to the suctioning and the landing deviation in the print base material 90. FIG. 7A illustrates a relationship between the velocity of wind relating to a small-sized dot and the landing deviation, FIG. 7B illustrates a relationship between the velocity of wind relating to a middle-sized dot and the landing deviation, and FIG. 7C illustrates a relationship between the velocity of wind relating to a large-sized dot and the landing deviation. FIGS. 7A to 7C illustrate the horizontal axis indicates each of the short heads of the line head 32C, and each of the short heads is illustrated by numerals identical to those of each of the short heads illustrated in FIG. 2. In FIGS. 7A to 7C, the vertical axis indicates the amount of the landing deviation (m) from a preset landing position. In FIGS. 7A to 7C, the amount of the landing deviation in a case in which the velocity of wind near the print base material 90 is 1.1 m/s is illustrated by a polygonal line of a solid line, the amount of the landing deviation in a case in which the velocity of wind is 1.9 m/s is illustrated by the polygonal line of a dashed line, and the amount of the landing deviation in a case in which the velocity of wind is 3.9 m/s is illustrated by the polygonal line of a two-dotted line. In the embodiment, the distance between the suction port 341 and the print base material 90 is 0.8 mm.

The dots having each size illustrated in FIGS. 7A to 7C, can be obtained by performing an experiment in which a relationship between the velocity of wind near the print base material 90 and the landing deviation in the print base material 90 makes the suction force of the pump 49 be changed and the ink droplets are discharged, and thus the deviation amount thereof is measured. The velocity of wind is measured by inserting a probe of the velocity of wind meter (Model 6244) of Kanomax Co., Ltd. 4-channel Anemo master in between suction port 341 and the print base material 90. However, since the probe is not inserted between the suction port 341 and the print base material 90 in a case in which a distance between the suction port 341 and the print base material 90 is 0.8 mm, the velocity of wind is predicted based on a measured result measured by widening a distance between the suction port 341 and the print base material 90.

As illustrated in FIGS. 7A to 7C, even when regarding dots having any size, the landing deviation is not generated in all of the short heads in a case in which the velocity of wind is 1.1 m/s. Whereas, when the velocity of wind is 1.9 m/s, regarding the middle-sized dot and the large-sized dot, the landing deviation is generated in a part of the short head, and regarding the small-sized dot, the landing deviation is generated in the other nine short heads except two short heads H9 and H10. When the velocity of wind is 3.9 m/s, even in the dots having any sizes, the landing deviation is generated in all of the short heads. Therefore, when the velocity of wind is equal to or less than 1.1 m/s, it is recognized that the landing deviation is not generated. Here, when the velocity of wind near the print base material 90 is specified, based on an area of the suction port 341, and the suction port 341 and the velocity of wind, an amount of wind (suction force) in the suction port 341 can be specified. For example, when the area of the suction port 341 is 0.001818 $m^2$, and the velocity of wind is 1.1 m/s, the amount of wind in the suction port 341 is approximately 0.12 $m^3$/min. Therefore, in the relationship illustrated in FIGS. 7A to 7C, an upper limit of the suction force of the pump 49 is a force in which the amount of wind in the suction port 341 becomes 0.12 $m^3$.

Whereas, the suction force of a lower limit of the suction force of the pump 49 can be set depending on the amount of the mist type ink droplets which are not surely suctioned and are landed onto the print base material 90. That is, when the suction force decreases, the mist type ink droplets are landed onto the print base material 90 without being suctioned, and it affects the image quality, driving apparatus, or the image quality by being landed onto members inside the apparatus. For example, when the mist type ink droplets are landed onto the nozzle surface of the line head, there is a concern that the port of the nozzle Nz is clogged by the mist type ink droplets attached on the nozzle surface or an aggregation thereof, and landing accuracy of the ink droplets is deteriorated. Here, the lowest suction force, in which the ink droplets are landed onto the print base material 90 and does not affect the image quality, is determined as a lowest value. For example, it is determined as follows. First, the apparatus is driven successively at a predetermined period (for example, 24 hours) by changing the suction force of the pump 49, the number of the landed mist type ink droplets is counted per unit area. In addition, the suction force in which the number of the mist type ink droplets does not affect the image quality is specified. The number of the mist type ink droplets influence on the image quality may be set to, for example, 2500 droplets per 1 $mm^2$ nozzle surface. When performing this experiment, for example, it is obtained that the amount of wind in the suction port 341 is 0.08 $m^3$/min. Accordingly, the suction force of the pump 49 in Step S215 can be set the suction force in which the amount of wind in the suction port 341 is 0.08 $m^3$/min or more and 0.1 $m^3$/min or less. Moreover, the suction force is preferably determined to be a value closer to the upper limit in the range of the amount of wind in order to prevent generation of the landing deviation or an influence on the image quality, as much as possible.

As described above, the flushing is performed every time the previous ink droplets are discharged and the predetermined period has elapsed. For this reason, when the ink is regularly discharged from the nozzle Nz, increasing of the thickened ink and bubbles inside the nozzle Nz is suppressed, and foreign matter near the nozzle Nz is suppressed.

Figure 8:
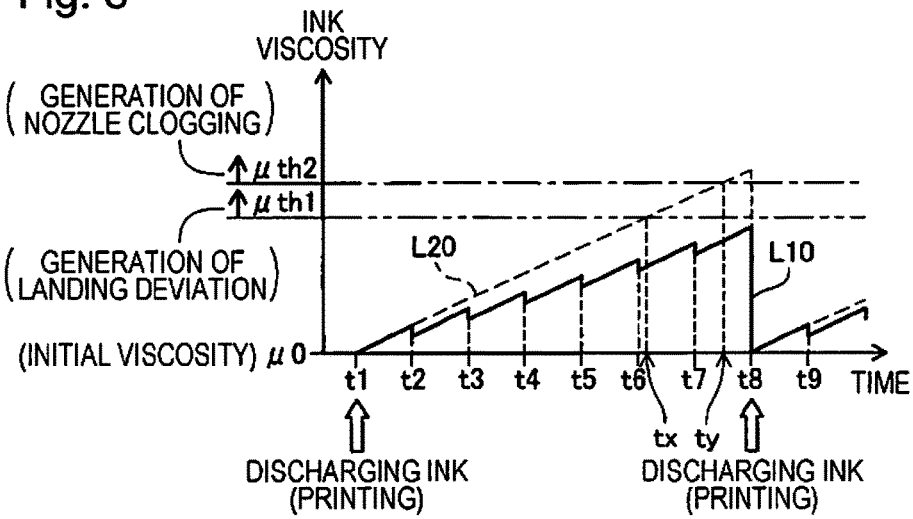
FIG. 8 is an explanation diagram illustrating an example of a change of viscosity of ink inside a nozzle Nz.
Figure 9:
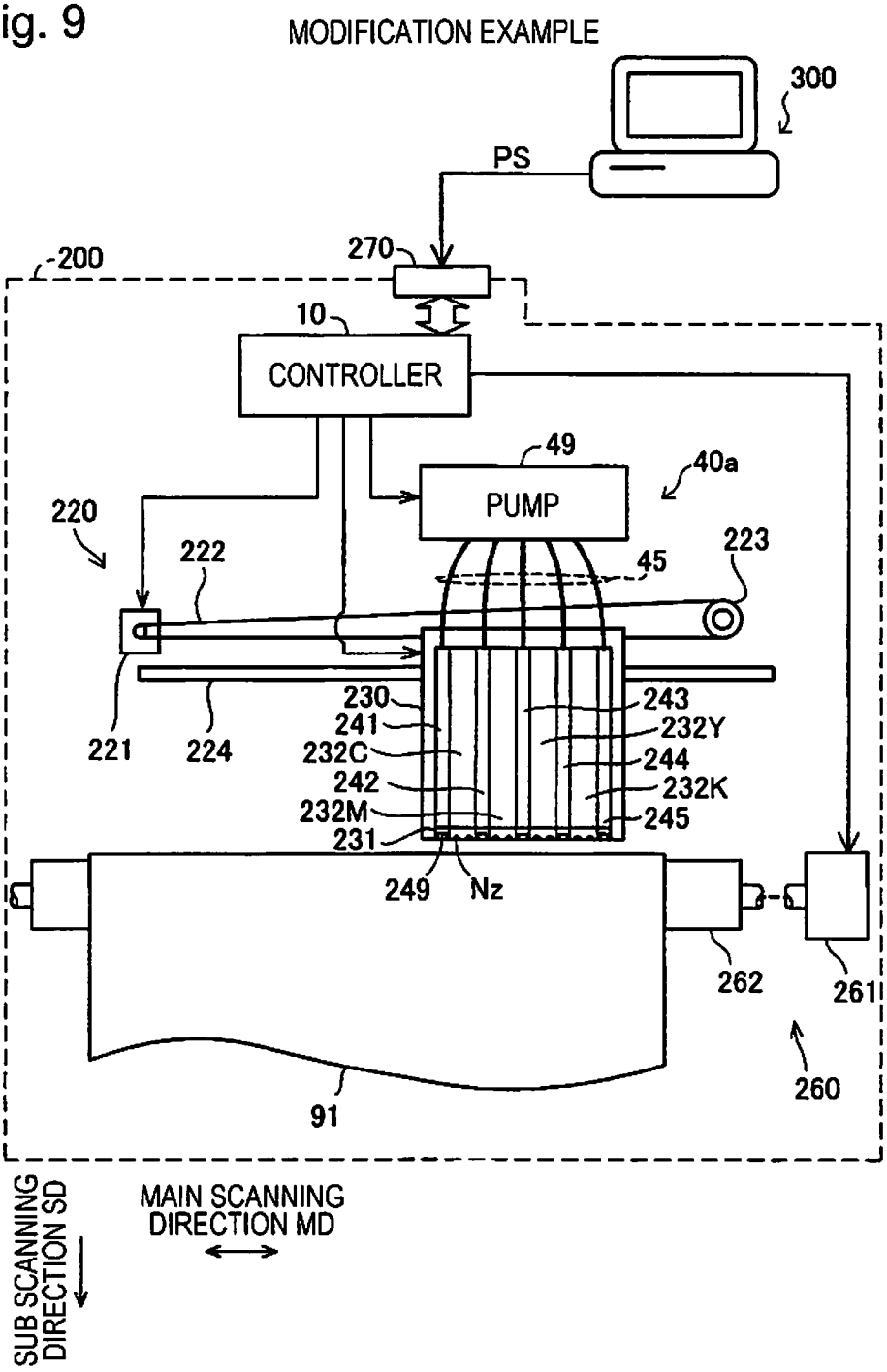
FIG. 9 is an explanation diagram illustrating a schematic configuration of a printing apparatus 200 in a modification example.

FIG. 8 is an explanation diagram illustrating an example of changing of the viscosity of the ink inside the nozzle Nz. In FIG. 8, a horizontal axis indicates time, and a vertical axis indicates the viscosity of the ink inside the nozzle Nz. In FIG. 8, the polygonal line L10 illustrated by a solid line indicates changing of the viscosity of the ink inside the nozzle Nz in the printing apparatus 100 of the embodiment, and the polygonal line L20 illustrated by a broken line indicates changing of the viscosity of the ink inside the nozzle in a comparative example. In this embodiment, at a time t1, after the ink droplets for forming the image are discharged, the flushing is regularly performed during times t2 to t7. After discharging the ink droplets for forming the image, the ink inside the nozzle Nz is dried with a lapse of time, and the viscosity of the ink is slowly increased from an initial viscosity μ0. However, since the mist type ink droplets are discharged every flushing, the viscosity of the ink inside the nozzle Nz is slightly decreased. Also, in the examples of FIG. 8, the ink droplets for forming the image are discharged at the time t8, and the viscosity of the ink inside the nozzle Nz is decreased down to the initial viscosity μ0.

Whereas, in the comparative example, flushing is not regularly performed. Therefore, after the time t1, the viscosity of the ink inside the nozzle is increased and reaches viscosity μth1 which is a threshold of the viscosity where the landing deviation is generated at a time tx. At a time ty before the time t8, the viscosity of the ink the nozzle reaches the viscosity μth2 which is a threshold of the viscosity where the nozzle is clogged. For this reason, it becomes impossible to discharge the ink droplets at the time t8. Meanwhile, in the printing apparatus 100 of the embodiment, in order to perform the flushing regularly performed, the viscosity of the ink inside the nozzle Nz is lower than the viscosity μth1 even at the time t8. For this reason, the ink droplets can be discharged without generating the landing deviation at the time t8.

Moreover, in a predetermined period of Step S210, that is, a time interval of the flushing when discharging of the ink droplets for forming the image is not performed can be arbitrary set. For example, when a maintenance of the printing apparatus 100 is regularly performed, within a maintained period thereof (period of time between maintenance and next maintenance), in order not to increase the viscosity of the ink when the thickened ink cannot be removed by the maintenance in the nozzle Nz which has not yet been used to discharge the ink droplets for forming the image, the interval of the flushing may be set. In addition, in the nozzle Nz which has not yet been used to discharge the ink droplets for forming the image within the maintenance period, the interval of the flushing is preferably set so as not to generate the landing deviation in the discharged ink droplets by increasing the viscosity of the ink inside the nozzle Nz at the time of discharging of the ink droplets for forming the image.

In the printing apparatus 100 of the embodiment described above, when each of the nozzles Nz does not discharge the ink droplets for forming the image, each of the nozzles Nz regularly discharges the mist type ink droplets, and the ink droplets (the mist type ink droplets) are suctioned by the suction section 40 and recovered, and thus the discharged ink droplets discharged by the flushing can be controlled to be landed onto the print base material 90 or members inside the apparatus. For this reason, deterioration of the image quality of the print region in the print base material 90 can be suppressed, and the ink droplets being landed onto a region between the print region and the print region can be suppressed. In addition, even when the print base material 90 is exchanged and printing is performed on a print base material having a width greater than that of each of the line heads, the flushing is performed on all of the nozzles Nz. In addition, in each of the nozzles Nz, a nozzle discharges the mist type ink droplets while the ink droplets for forming the image are not discharged, and the nozzle Nz can discharge the mist type ink droplets even while the other nozzle Nz are discharged the ink droplets for forming the image. For example, in two short head rows constituting the line head having the same color, among the two nozzles Nz overlapped with each other when seen in the transportation direction PD in the overlap region OA, while one nozzle Nz discharges the ink droplets for forming the image, the other nozzle Nz can discharge the mist type ink droplets. For this reason, even during the image printing, the flushing can be performed, and a decrease in print throughput can be suppressed. In addition, since the mist type ink droplets are discharged when a predetermined time has elapsed from discharging the previous ink droplets, the nozzle Nz can regularly discharge the ink droplets. For this reason, the ink inside the nozzle Nz being thickened can be suppressed, the landing deviation caused by such thickening can be suppressed.

In addition, at the time of the flushing, as the mist type ink droplets, the ink droplets (mist type ink droplets) capable of being floated in an interval between the nozzle Nz and the print base material 90 are discharged, and thus being landed thereof onto the print base material 90 can be suppressed. In addition, suctioning is performed using the pump 49 at the suction force capable of recovering the mist type ink droplets, being landed of the ink droplets onto the print base material 90 or the members of the apparatus at the time of the flushing can be further reliably suppressed.

In addition, since each of the ink collecting sections is disposed with respect to each of the mutually different line heads near the downstream side of the transportation direction PD, compared to a configuration in which each of the ink collecting sections is disposed on the other position, the mist type ink droplets having a tendency of flowing downward in the transportation direction PD in accordance with transporting of the print base material 90 after being discharged from each other of the nozzles Nz, can be further reliably recovered.

<B. Modification Example>

<B-1. Modification Example 1>

In each of the embodiments, the printing apparatus 100 is the line head printer, or may be configured as a serial head printer.

FIG. 10 is an explanation diagram illustrating a schematic configuration of a printing apparatus 200 in the modification example. The printing apparatus 200 forms an image on a recording sheet 91 when a carriage on which the printing head is mounted is reciprocated in the main scanning direction MD and the recording medium is transported in a sub scanning direction SD orthogonal to the main scanning direction MD. The main scanning direction MD corresponds to a subordinate concept of the relative moving direction in Claims. In the modification example, the "upstream" and the "downstream" mean the upstream and the downstream of the main scanning direction MD as a reference, a proceeding direction of the printing head becomes the upstream. The printing apparatus 200 includes a controller 10, a suction section 40*a*, a carriage transportation section 220, a carriage 230, four ink cartridges 232C, 232M, 232Y, and 232K, a recording medium transportation section 260, and a connector 270. The controller 10 has a configuration identical to that of the controller 10 in the printing apparatus 100 of the first embodiment.

The suction section 40*a* has a difference from the suction section 40 of the first embodiment in that five ink collecting sections 241, 242, 243, 244, and 245 are included therein instead of the four ink collecting sections 34C, 34M, 34Y, and 34K. The other configurations of the suction section 40*a* of a second embodiment are identical to those of the suction section 40 of the first embodiment, and thus the same components thereof are given the same numerals, and a detailed description thereof will not be repeated. The five ink collecting sections 241, 242, 243, 244, and 245 are disposed between each of the ink cartridges, and disposed on the outside of the ink cartridge positioned at an end. Specifically, the ink collecting section 241 is disposed to be in contact with the outside of the main scanning direction MD with respect to the ink cartridge 232C. The ink collecting section 242 is disposed in contact with the two ink cartridges 232C and 232M between the two ink cartridges 232C and 232M. The ink collecting section 243 is disposed in contact with the two ink cartridges 232M and 232Y between the two ink cartridges 232M and 232Y. The ink collecting section 244 is disposed in contact with the two ink cartridges 232Y and 232K between the two ink cartridges 232Y and 232K. The ink collecting section 245 is disposed in contact with the outside of the main scanning direction MD with respect to the ink cartridge 232K. The suction port 249 is formed on a surface of each of the ink collecting sections 241, 242, 243, 244, and 245 facing the recording sheet 91.

The carriage transportation section 220 includes a carriage motor 221, a driving belt 222, a pulley 223, and a sliding shaft 224. The carriage motor 221 drives the carriage 230 in the main scanning direction MD through the driving belt 222. The driving belt 222 is an endless belt which is stretched between the carriage motor 221 and the pulley 223, and is connected to the carriage 230. The carriage 230 is slidably supported by the sliding shaft 224.

Four ink cartridges 232C, 232M, 232Y, and 232K are attachably mounted on the carriage 230, in addition, five ink collecting sections 241, 242, 243, 244, and 245 are also mounted. The carriage 230 includes a printing head 231 facing the recording sheet 91, and the printing head 231 discharges the ink droplets. The four ink cartridges 232C, 232M, 232Y, and 232K has each of cyan ink, magenta ink, yellow ink, and black ink.

The recording medium transportation section 260 includes a paper feeding motor 261, and a paper feeding roller 262 driven by the paper feeding motor 261. The recording medium transportation section 260 transports the recording sheet 91 from a sheet supplying section (for example, sheet tray) to a paper discharging section (for example, discharging tray) along the sub scanning direction SD in the printing apparatus 200.

The connector 270 includes a connection interface such as USB (universal serial bus), and an external device is connected to the printing apparatus 200 through the connection interface. In an example of FIG. 10, a personal computer 300 is connected to the connector 270 through a connection cable PS. In the personal computer 300, driver software for the printing apparatus 200 is installed, and the controller 10 receives an instruction of printing output from the driver software.

Either or both of the carriage motor 221 and the carriage 230 are connected to the controller 10. The controller 10 reciprocates the carriage 230 in the main scanning direction MD with respect to the recording sheet 91 by driving the carriage motor 221, in addition, moves the recording sheet 91 in the sub scanning direction SD by driving the paper feeding motor 261. The printing apparatus 200 forms an appropriate color dot on an appropriate position on the recording sheet 91 by driving the nozzle Nz included in the printing head 231 at an appropriate timing according to reciprocating of the carriage 230 (main scanning) or transporting the recording sheet 91 (sub scanning) based on printing data.

In the printing apparatus 200, a printing process is performed that is identical to that of the printing apparatus 100. Moreover, the printing process may be as follows. Step S105 and S110 are performed in a personal computer 300, the printing apparatus 200 receives the bit map data which indicates turning ON and OFF of the dot obtained by the halftone process, and Step S115 is performed in the printing apparatus 200. In addition, in the printing apparatus 200, the ink discharging control process is performed identically to that of the printing apparatus 100. That is, when the ink droplets for forming the image are not discharged from each of the nozzles Nz, and when a predetermined time is elapsed after discharging the previous ink droplets, the flushing is performed.

Each of the ink cartridges is sandwiched between two ink collecting sections adjacent to the main scanning direction MD. Therefore, even when the carriage 230 performs scanning in any direction of the main scanning direction MD, the ink collecting section exists on the downstream side of the scanning direction. When the flushing is performed during scanning, the mist type ink droplets are likely to flow toward the downstream side of the scanning direction, and the mist type ink droplets can be reliably suctioned and recovered by the ink collecting section positioned at the downstream side.

The printing apparatus 200 in the modification example including such a configuration described above also includes the same effects as the printing apparatus 100. Moreover, in the printing apparatus 200, instead of five ink collecting sections 241, 242, 243, 244, and 245, or including the five ink collecting sections 241, 242, 243, 244, and 245, the ink collecting sections may be provided on the downstream side of the sub scanning direction SD. In the above described modification example, the carriage transportation section 220, the recording medium transportation section 260, and the controller 10, which controls the transportation section, correspond to a subordinate concept of the transportation section in Claims. In addition, the recording sheet 91 corresponds to a subordinate concept of the recording medium in Claims.

<B-2. Modification Example 2>

In each of the embodiments, the suction ports of the four ink collecting sections 34C, 34M, 34Y, and 34K are disposed near the downstream side of the transportation direction PD, with respect to the mutually different line heads; however, the invention is not limited thereto. Each of the mutually different line heads may be disposed near the upstream side of the transportation direction PD. In addition, as a functional section in which the ink collecting section and the line head are combined, for example, illustrated in FIG. 2, the suction port may be disposed in a space where the short head is not disposed, such as the upstream side in the X direction of the short head H1 and an empty space of the short head H1 side in the Y direction of the short head H2.

<B-3. Modification Example 3>

In the first embodiment, in Step S215, the suction controller 13 suctions the mist type ink droplets by controlling the suction section 40; however, the suction sections 40 and 40*a* may start to suction according to turning on the printing apparatus 100 and the printing apparatus 200, or according to starting of printing. According to the above description, the mist type ink generated according to discharging of the ink droplets for forming the image can be suctioned.

<B-4. Modification Example 4>

In the first embodiment, further, an amount of the ink of the mist type ink droplets when the line head 32 is at a position facing a region between the print regions may be greater than an amount of the ink of the mist type ink droplets when the line head 32 is at a position facing the print region, and the suction force of the pump 49 when the line head 32 is at a position facing a region between the print regions may be greater than a suction force of the pump 49 when the line head 32 is at a position facing the print region. When the line head 32 is at a position facing a region between the print regions, the ink droplets for forming the image are not discharged from the line head 32, and thus deterioration of image quality generated due to the landing deviation is not generated even when the suction force of the suction section 40 is strong. For this reason, when the suction force of the pump 49 is strong and an amount of the ink of the mist type ink droplets is increased, thickened ink or bubbles inside the nozzle Nz are likely to be removed. In this case, the pump 49 is provided to each of the suction ports 341, or with respect to the tube 45, a valve capable of controlling the suction force is provided, the valve corresponding to the line head 32 at a position facing a region between the print region and the print region is controlled, and thus the suction force may be controlled. Moreover, the print region in the modification example indicates a region in the print base material 90, and also a region in which the image is formed based on the image data.

<B-5. Modification Example 5>

The printing apparatus 100 is described as an ink jet printer; however, an arbitrary liquid ejecting apparatus which ejects the other liquid other than the ink may be used. For example, there are various liquid ejecting apparatuses as follows.

(1) an image recording apparatus such as a facsimile apparatus (2) a color material ejecting apparatus which is used to manufacture a color filter for an image display apparatus such as a liquid crystal display (3) an electrode material ejecting apparatus which is used to form an electrode such as an organic electro luminescence (EL) display or a field emission display (FED)

(4) a liquid ejecting apparatus which ejects liquid containing a biological organic substance used for manufacturing a biochip (5) a sample ejecting apparatus as a precision pipette (6) a lubricating oil ejecting apparatus (7) a resin solution ejecting apparatus (8) a liquid ejecting apparatus which ejects lubricating oil in a pinpoint manner to a precision mechanism such as a watch or a camera (9) a liquid ejecting apparatus which ejects a transparent resin solution such as an ultraviolet curing resin solution for forming a micro hemispherical lens (optical lens) used for an optical communication element, or the like onto a substrate

(10) a liquid ejecting apparatus which ejects an acidic or alkaline etching solution for etching a substrate, or the like

(11) a liquid ejecting apparatus which includes a liquid ejecting head discharging a minimum amount of the other ink droplets Moreover, the "liquid droplets" described above refers to a state of the liquid discharged from the printing apparatus and the liquid ejecting apparatus, and a liquid droplet has a tail drawn in a granular, tear, or string shape. In addition, the "liquid" described here is a material as long as the material is capable of being ejected from the liquid ejecting apparatus. For example, the "liquid" is not particularly limited as long as the material is in a state of a liquid-phase substance. The "liquid" also includes a material having high or low viscosity, and liquid type material such as sol, gel water, other inorganic solvents, organic solvents, solutions, liquid resins, and a liquid metal (metal melt). In addition, not only a liquid as a type of the material, but also particles of a functional material constituted by a solid material such as pigment or metal particles, which are dissolved, dispersed, or mixed in a solvent, are included in the "liquid". In addition, a representative example of the liquid includes the ink, the liquid crystal, or the like described above. Here, the ink includes various liquid compositions such as general water-based ink, oil-based ink, gel ink, and hot melt ink.

<B-6. Modification Example 6>

A part of a configuration realized by hardware in each of the embodiments and the modification examples may be substituted by software, on the contrary, a part of the configuration realized by the software in each of the embodiments and the modification examples may be substituted by the hardware. In addition, when a part or the entirety of functions of the invention is realized by software, the software (computer program) can be provided in a state in which the software is stored in a recording medium capable of being read by the computer. In the invention, the "recording medium capable of being read by the computer" is not limited to a portable recording medium such as a floppy disk or a CD-ROM, and also includes an internal storage device inside the computer such as various RAM or ROM, and an external storage device which is fixed to the computer such as a hard disk. That is, the "recording medium capable of being read by the computer" has broad meaning in which an arbitrary recording medium is capable of not only temporally storing data but also permanently storing.

The invention is not limited to the embodiments and the modification examples described above, and can be realized as various configurations within a range without departing from the spirit of the invention. For example, technical features of the embodiments and the modification examples corresponding to technical features in each of the aspects disclosed in SUMMARY can be appropriately changed or combined with each other so as to solve a part or the entirety of the problems described above or to achieve a part or the entirety of the effects described above. In addition, if the technical features are not necessary in this specification, it is possible to be appropriately removed.

REFERENCE SIGNS LIST

10 Controller
11 Transportation controller
12 Discharging controller
13 Suction controller
14 Color converter
15 Halftone processing section
16 Image data storage
20 Base material delivery section
21 Base material roller
30 Print section
31 Rotation drum
32C Line head
32K Line head
32M Line head
32Y Line head
34C Ink collecting section
34K Ink collecting section
34M Ink collecting section
34Y Ink collecting section
40 Suction section
40*a* Suction section
45 Tube
49 Pump
50 Base material winding section
51 Winding roller
61 Transportation roller
90 Print base material
91 Recording sheet
100 Printing apparatus
200 Printing apparatus
220 Carriage transportation section
221 Carriage motor
222 Driving belt
223 Pulley
224 Sliding shaft
230 Carriage
231 Printing head
232C Ink cartridge
232K Ink cartridge
232M Ink cartridge
232Y Ink cartridge
241 to 245 Ink collecting section
249 Suction port
260 Recording medium transportation section
261 Paper feeding motor
262 Paper feeding roller
270 Connector
300 Personal computer
341 Suction port
H1 to H3 and H9 to H11 Short head
HC1 Short head row
HC2 Short head row L1 Straight line
L10 Polygonal line
L2 Straight line
L3 Straight line
L4 Straight line
L20 Polygonal line
MD Main scanning direction
Nz Nozzle
OA Overlap region
PD Transportation direction
PS Connection cable
p1 Expansion component
p2 Expansion maintaining component
p3 Contraction component
p4 Contraction maintaining component
p5 Return component
R1 Voltage range
R2 Voltage range
R3 Voltage range
SD Sub scanning direction
VB Reference potential
VH Expansion potential
vh1 Driving voltage
VL Contraction potential

The invention claimed is:

1. The printing apparatus which forms an image by discharging liquid onto a recording medium based on image data, comprising:

a printing head that includes a plurality of nozzles including a first nozzle and discharges the liquid from the plurality of nozzles;

a discharging controller that is capable of controlling discharging of the liquid from the plurality of nozzles;

a transportation section that relatively moves the recording medium and the printing head; and a suction section that includes a suction port which is positioned at an upstream side or a downstream side of the printing head in a relative moving direction of the printing head and the recording medium, wherein at a timing of not discharging ink droplets for forming the image as the liquid from the first nozzle, the discharging controller controls the first nozzle to discharge mist type ink droplets as the liquid, and the suction section suctions the mist type ink droplets discharged from the first nozzle through the suction port, wherein the plurality of nozzles includes a second nozzle different from the first nozzle, wherein the discharging controller controls the second nozzle to discharge the mist type ink droplets, at a timing of discharging the ink droplets for forming the image from the first nozzle, and at a timing of not discharging the ink droplets for forming the image from the second nozzle, and wherein the suction section performs the suctioning with a suction force which is not capable of recovering the ink droplets for forming the image discharged from the first nozzle, and is capable of recovering the mist type ink droplets discharged from the second nozzle.

2. A printing apparatus which forms an image by discharging liquid onto a recording medium based on image data, comprising:

a printing head that includes a plurality of nozzles including a first nozzle and discharges the liquid from the plurality of nozzles;

a discharging controller that is capable of controlling discharging of the liquid from the plurality of nozzles;

a transportation section that relatively moves the recording medium and the printing head; and a suction section that includes a suction port which is positioned at an upstream side or a downstream side of the printing head in a relative moving direction of the printing head and the recording medium, wherein at a timing of not discharging ink droplets for forming the image as the liquid from the first nozzle while the first nozzle is at a position facing the recording medium, the discharging controller controls the first nozzle to discharge mist type ink droplets as the liquid, and the suction section suctions the mist type ink droplets discharged from the first nozzle through the suction port, wherein the discharging controller controls the first nozzle to discharge the mist type ink droplets when the printing head is positioned at a position not facing a print region of the recording medium, and wherein an amount of the mist type ink droplets discharged from the first nozzle when the printing head is positioned at a position not facing the print region of the recording medium is greater than an amount of the mist type ink droplets discharged from the first nozzle when the printing head is positioned at a position facing the print region of the recording medium.

3. The printing apparatus according to claim 2, wherein the suction section performs the suctioning with a stronger suction force in a case in which the first nozzle discharges the mist type ink droplets when the printing head is positioned at a position not facing the print region of the recording medium, than in a case in which the first nozzle discharges the mist type ink droplets when the printing head is positioned at a position facing the print region of the recording medium.

4. The printing apparatus according to claim 2, wherein when a predetermined time has elapsed after the first nozzle terminates to discharge the ink droplets for forming the image or the mist type ink droplets, the discharging controller controls the first nozzle to discharge the mist type ink droplets.

5. The printing apparatus according to claim 2, wherein the plurality of nozzles includes a third nozzle different from the first nozzle, wherein the transportation section moves only the recording medium out of the recording medium and the printing head, wherein the printing head is a line head in which a first nozzle row including the first nozzle is arranged in a direction intersecting a moving direction of the recording medium, and a second nozzle row including the third nozzle is arranged in parallel to the first nozzle row, and wherein the suction section is disposed at a downstream side in the moving direction of the recording medium with respect to the printing head.

6. A method of controlling liquid discharging in a printing apparatus, the printing apparatus including a printing head that includes a plurality of nozzles including a first nozzle and discharges liquid from the plurality of nozzles, and a suction section that includes a suction port, and forming an image by discharging the liquid onto a recording medium based on image data, the method comprising:

(a) a process of discharging ink droplets for forming the image as the liquid from the first nozzle;

(b) a process of relatively moving the recording medium and the printing head;

(c) a process of discharging mist type ink droplets as the liquid from the first nozzle at a timing of not discharging the ink droplets for forming the image from the first nozzle while the first nozzle is at a position facing the recording medium;

(d) a process of suctioning the mist type ink droplets discharged from the first nozzle using the suction port which is positioned at an upstream side or a downstream side of the printing head in a relative moving direction of the printing head and the recording medium, the process of the discharging of the mist type ink droplets including discharging, the mist type ink droplets from the first nozzle when the printing head is positioned at a position not facing a print region of the recording medium, and an amount of the mist type ink droplets discharged from the first nozzle when the printing head is positioned at a position not facing the print region of the recording medium being greater than an amount of the mist type ink droplets discharged from the first nozzle when the printing head is positioned at a position facing the print region of the recording medium.

* * * * *